United States Patent [19]

Bischeltsrieder

[11] 4,004,402

[45] Jan. 25, 1977

[54] SADDLE TREE FOR RIDING SADDLES

[75] Inventor: Lorenz Bischeltsrieder, Furstenfeldbruck, Germany

[73] Assignee: Stubben GmbH, Riding Equipment, Langmattring, Switzerland

[22] Filed: Mar. 4, 1975

[21] Appl. No.: 555,194

[30] Foreign Application Priority Data

Oct. 23, 1974 Germany ..... 2450427
Mar. 6, 1974 Germany ..... 2410669

[52] U.S. Cl. ..... 54/44
[51] Int. Cl.[2] ..... B68C 1/00
[58] Field of Search ..... 54/44, 45, 46, 37, 42, 54/66

[56] References Cited

UNITED STATES PATENTS

| | | | |
|---|---|---|---|
| 30,118 | 9/1860 | Boyd | 54/44 |
| 209,415 | 10/1878 | Nothaf | 54/44 |
| 3,258,894 | 7/1966 | Hoaglin | 54/44 |
| 3,312,040 | 4/1967 | Nuzzo | 54/44 |
| 3,343,338 | 9/1967 | Stübben | 54/66 X |
| 3,888,070 | 6/1975 | White | 54/44 |

*Primary Examiner*—Louis G. Mancene
*Assistant Examiner*—Jack Q. Lever
*Attorney, Agent, or Firm*—Strauch, Nolan, Neale, Nies & Kurz

[57] ABSTRACT

A saddle tree composed of a front member having a neck and a waist and a separate cantle member fixed to the front member.

6 Claims, 4 Drawing Figures

SADDLE TREE FOR RIDING SADDLES

BACKGROUND

The production of saddle trees of the conventional type which are made either of wood and spring steel bands or of a plastic material is relatively costly. Saddle trees which are made of wood and spring steel bands require a considerable amount of manual work as well as a maintenance of supplies for a large number of various parts in several different lengths and widths depending on the size of the saddle to be produced for the assembly of the saddle trees. For saddle trees made of plastic material only parts for the various sizes are needed as manual work is almost not needed; however, this type of saddle tree demands a considerable amount of technical resources which is caused by the various sizes of the jet molds which are required for making differently sized saddle trees. Saddles made of plastic material also have some other disadvantages depending on the material used which result from the fact that the saddle tree must be of a different thickness which has a disadvantageous effect especially on the weight of the saddle tree.

The object of the invention is to provide a saddle tree which can be manufactured as economically as possible so that apparatuses requiring only little expenditure are necessary for manufacturing saddle trees in the various sizes.

According to the present invention, the object is solved in that the saddle tree of a chosen type is formed in two parts in such a way that on the cantle in its rear portion is mounted and secured thereon a cantle plate defining the size of the cantle with respect to the length and/or width and that the surface of said cantle plate smoothly and continuously passes into the surface of the part of the cantle which is not covered by the cantle plate.

This permits the production of a saddle tree having a uniform and optimum size which requires a minimum of expenditure of apparatuses so that in respect of the necessary modifications in order to give the saddle tree the desired size, i.e. the desired length and width, it is only necessary to mount a cantle plate which is fixed in a relatively simple manner requiring only little expenditure also with respect to its production.

In a saddle tree consisting of plastic material, the cantle e.g. has a flat recess or mold on its surface in the vicinity of the cantle plate which recess or mold the cantle plate of the desired size with its congruent bottom surface engages. It is particularly advantageous if the cantle plate consists of a plastic material having a lower specific weight with respect to the remaining saddle tree, e.g. polyurethane foam or the like. The fastening of the cantle plate onto the cantle can be effected by means of screws or adhesives. It is possible also to make the cantle plate of a conventional saddle tree consisting of either wood and spring steel or also of a plastic material in such a manner that the cantle plate has a hollow spaced in its bottom surface into which the cantle projects with its rear portion, so as to cause the rear portion of the cantle with its upper and lower surfaces to closely lie to the inner walls of the hollow space of the cantle plate and to firmly connect the cantle with the inner walls, e.g. by adhesion or by means of screws, if necessary.

It is also particularly advantageous to have a stop on the cantle of the saddle tree abut the rear, downwardly directed portion of the cantle plate by which the position of the mounted cantle plate is exactly defined. The drawings show the subject matter of the invention more clearly by means of a preferred embodiment.

FIGS. 1 through 4 of the drawings show two particularly preferred embodiments of the subject matter of the invention which are explained in detail in the following:

Figure 1:
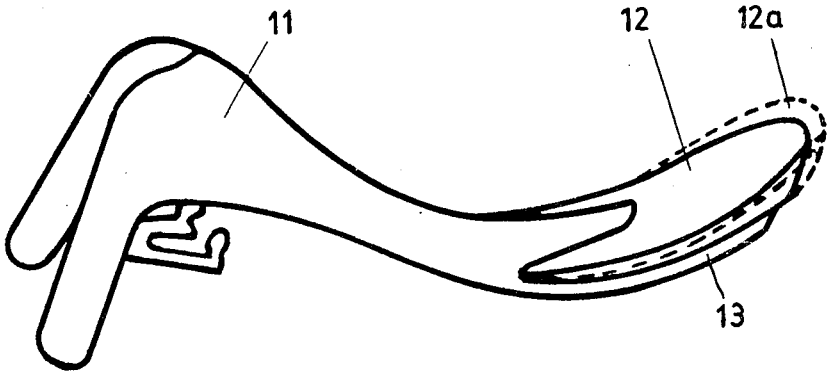
FIG. 1 shows a view of a saddle tree according to the invention made of a plastic material.
Figure 2:
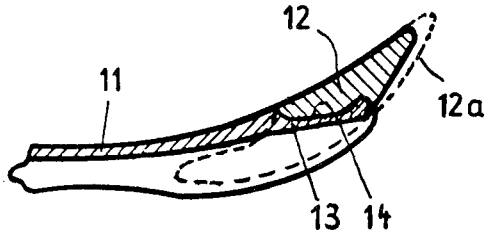
FIG. 2 shows a longitudinal section of the saddle tree according to FIG. 1 in the region of the cantle.
Figure 3:
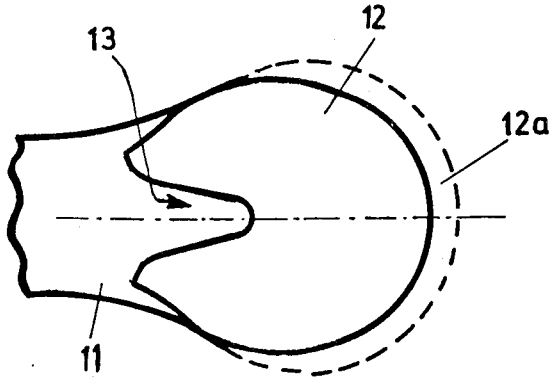
FIG. 3 shows a top view of the cantle of the saddle tree according to FIG. 1.

FIGS. 1 through 3 show that the saddle tree is made of a one-piece standard saddle tree part 11 made of plastic material andd that the cantle plate 12 is secured to the saddle tree in the region of the cantle 13 of the saddle tree part 11. The saddle tree part 11 on its upper surface has in the region of the cantle a flat recess or mold 14 into which the cantle plate 12 having lower surface which is adapted to the recess or mold is engaged or fitted. The cantle plate 12 is glued or screwed to the cantle 13 of the saddle tree part 11, or is secured thereto by means of both fastening means.

Figure 4:
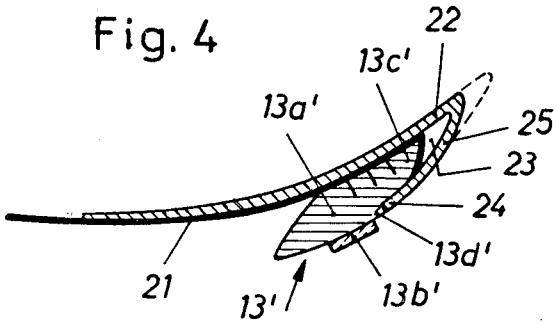
FIG. 4 shows a section through the cantle of a conventional saddle tree formed according to the invention.

Depending on the size of the saddle tree as desired an accordingly formed cantle plate **12*a* is used. The dotted line for the outlines of a larger, i.e. longer and broader, cantle plate or part 12*a* show that the saddle tree obtains a greater length when using this cantle part and thus also the saddle which has been equipped with this saddle tree. A conventional saddle tree, of which the rear cantle piece is shown in FIG. 4, has its wooden part 13*a*' in the range of the cantle 13' reinforced and stiffened by a spring steel band piece 13*b*'. On the wooden part 13*a*' of the cantle are arranged the longitudinal girths 21 in the usual manner. The cantle piece 13' mounts the cantle plate 22 and projects the same backwardly and laterally depending on the desired size of the saddle tree with respect to the required length and width. The cantle plate 22 has a hollow space 23 into which projects the rear portion 13*c*' of the cantle 13' of the saddle tree. In order to define the position of the cantle plate 22 with respect to the rear cantle 13', the cantle 13' is provided with a stop 13*d*' which the edge 24 on the rear, downwardly directed rim 25 of the cantle plate 22** abuts.

The advantage of the saddle tree according to the invention is that one need produce only one standard saddle tree which can be provided with a cantle plate to define the desired size of the saddle tree which is relevant for the final size, i.e. the length and width of the saddle tree.

I claim:

1. A saddle tree which comprises a front saddle tree member having a neck with points depending therefrom, a waist extending rearwardly from said neck, and mounting means adapted to receive cantles of different lengths and widths so that saddle trees of different sizes can be made using identical front saddle tree members, said mounting means comprising a recess in the upper surface of said front saddle tree member providing laterally extending, forward and rearward means for locating a cantle relative to said front saddle tree member; a separate cantle member seated in said recess, said cantle abutting the forward locating means and a lower surface portion thereof being configured to match said recess, thereby positioning said cantle relative to said front saddle member; and means fixing said cantle member to said front saddle tree member.

2. A saddle tree as defined in claim 1 in which the cantle is fabricated from a material having a lower specific weight than the material from which the front saddle tree member is made.

3. A saddle tree as defined in claim 1 in which the cantle is made from a polyurethane foam.

4. A saddle tree which comprises a first saddle tree member having mounting means adapted to receive cantles of different lengths and widths so that saddle trees of different sizes can be made using identical saddle tree members, said mounting means including a transversely extending stop on the bottom side of said saddle tree member for locating a cantle relative to said member; a separate cantle having a forwardly opening recess therein fitted over said saddle tree member with the rear portion of the latter extending into and being contoured to match said recess and the forward edge of the portion of the cantle below the saddle tree member abutting the stop formed on the lower side of said saddle tree member, thereby locating said cantle relative to said saddle tree member; and means fixing said cantle to said saddle tree member.

5. A saddle tree as defined in claim 4 in which the cantle is fabricated from a material having a lower specific weight than the material from which the front saddle tree member is made.

6. A saddle tree member as defined in claim 4 in which the cantle is made from a polyurethane foam.

* * * * *